US007478438B2

(12) United States Patent
Lolis

(10) Patent No.: US 7,478,438 B2
(45) Date of Patent: Jan. 20, 2009

(54) PROTECTIVE CLOTHING OR LINING

(76) Inventor: Nikolaus Lolis, Von Vallmar Str. 33, Roth, D-91154 (DE)

( * ) Notice: Subject to any disclaimer, the term of this patent is extended or adjusted under 35 U.S.C. 154(b) by 0 days.

(21) Appl. No.: 10/536,201

(22) PCT Filed: Oct. 22, 2003

(86) PCT No.: PCT/DE03/03458

§ 371 (c)(1),
(2), (4) Date: Apr. 3, 2006

(87) PCT Pub. No.: WO2004/039184

PCT Pub. Date: May 13, 2004

(65) Prior Publication Data

US 2006/0212985 A1 Sep. 28, 2006

(30) Foreign Application Priority Data

Oct. 25, 2002 (DE) ..... 202 16 464 U

(51) Int. Cl.

| | |
|---|---|
| ***F41H 1/00*** | (2006.01) |
| ***F41H 1/02*** | (2006.01) |
| ***A41D 13/015*** | (2006.01) |
| *F41H 13/00* | (2006.01) |
| *F41H 5/08* | (2006.01) |

(52) U.S. Cl. ..... 2/2.5; 2/22; 2/24; 2/411; 2/414

(58) Field of Classification Search ..... 2/2.5, 2/22, 24, 410, 411, 412, 414; 428/73, 116
See application file for complete search history.

(56) References Cited

U.S. PATENT DOCUMENTS 4,422,183 A * 12/1983 Landi et al. ..... 2/455
4,472,471 A 9/1984 Klein et al.
4,485,568 A * 12/1984 Landi et al. ..... 36/44
4,845,863 A * 7/1989 Yung-Mao ..... 36/114
5,110,653 A * 5/1992 Landi ..... 428/116
5,122,405 A * 6/1992 Landi ..... 428/116
5,174,049 A * 12/1992 Flemming ..... 36/28
5,203,607 A * 4/1993 Landi ..... 297/214
5,289,878 A * 3/1994 Landi et al. ..... 168/14
5,349,893 A * 9/1994 Dunn ..... 89/36.05
5,496,610 A * 3/1996 Landi et al. ..... 428/73
5,561,866 A * 10/1996 Ross ..... 2/410
5,794,271 A * 8/1998 Hastings ..... 2/412
6,151,714 A * 11/2000 Pratt ..... 2/24

(Continued)

FOREIGN PATENT DOCUMENTS

DE G9305803.9 8/1994

(Continued)

*Primary Examiner*—Bobby H Muromoto, Jr.
(74) *Attorney, Agent, or Firm*—Lackenbach Siegel, LLP; Andrew F. Young, Esq.

(57) ABSTRACT

Protective clothing or a lining for protection against the effects of impacts, blows, gunshots or the like, includes an inner side facing the person wearing it and an outer side facing away from the object, wherein the outer side consists of at least one layer of a non-tear material while the inner side consists of an elastic, self-supporting, repetitive geometrical structure. The structure is covered on the top by the layer of non-tear material and is open at the bottom, the structure forming a continuous system of air chambers which are closed from one another by side walls.

10 Claims, 1 Drawing Sheet

U.S. PATENT DOCUMENTS

2006/0212985 A1 * 9/2006 Lolis ..... 2/2.5

FOREIGN PATENT DOCUMENTS

DE 4336468 4/1995
DE 19845705 A1 * 4/2000
DE 20119034 U1 11/2001
EP 881064 A2 * 12/1998
GB 2349798 A 11/2000

* cited by examiner

Fig. 1
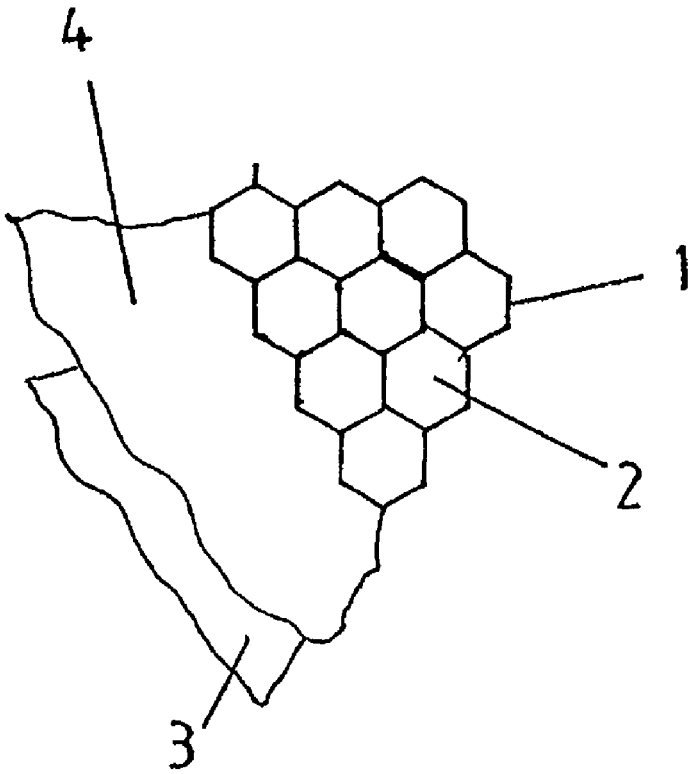
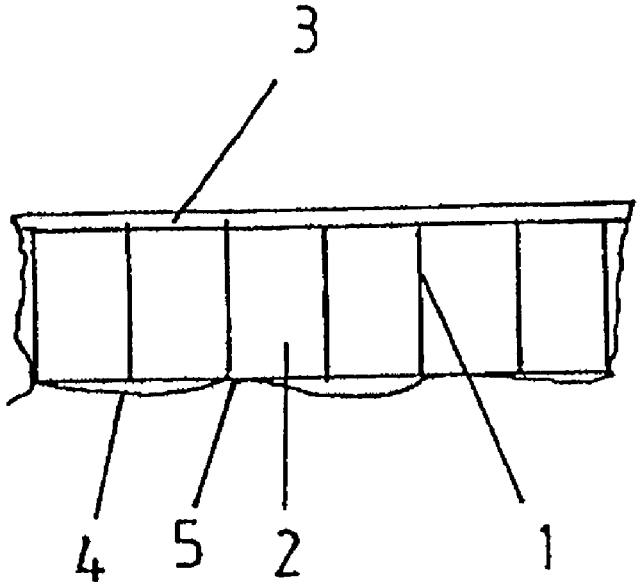
Fig. 2

PROTECTIVE CLOTHING OR LINING

CROSS REFERENCE TO RELATED APPLICATIONS

This application claims priority from PCT/DE2003/003458 filed Oct. 22, 2003, which in turn claims priority from DE 202 16 464.0 filed Oct. 25, 2002. The contents of both of which are incorporated herein by reference in their entity.

BACKGROUND OF THE INVENTION

1. Field of the Invention

The present invention relates to protective clothing or lining for protecting a user against impacts generated by gunshots, heavy blow and the like.

2. Description of the Related Art

The related art involves protective clothing or lining against the effect of hail, falling rocks, gunshots or the like which been proposed numerous times, especially in the past few years since the increasing occurrence of storms with hail.

For example, protective weather clothing comprised of two layers of a laminated or coated material between which distancing material or fleece is arranged is disclosed in DE 201 19 034.

It is also known to line helmets with inside lining made of foamed material, in order to protect against the effects of impact.

What is not appreciated by the prior art is the need for protective clothing that has good energy absorbing characteristics and yet is light and may be worn as closing or as lining in helmets.

Accordingly, there is a need for improved protective closing or lining material.

OBJECTS AND SUMMARY OF THE INVENTION

An object of the present invention is to provide protective clothing or lining that is characterized by good energy absorbing properties, that in the form of clothing can be successfully used both as clothing and as lining in helmets, for example.

According to one aspect of the present invention, protective clothing or lining for protection against the effect of impacts, blows, gunshots or the like comprises an inner side facing the person wearing it and an outer side facing away from the person, wherein the outer side consists of at least one layer of a non-tear material, characterized in that the inner side consists of an elastic, self-supporting, repetitive geometrical structure, in that the structure is covered on the top (i.e., the outer side) by a layer of non-tear material and is open in the bottom, said structure forming a substantially continuous system of air chambers which are closed from one another by walls.

According to another aspect of the present invention, protective clothing or lining for protection against the effect of impacts, blows, gunshots or the like includes an inner side facing the person wearing it and an outer side facing away from the person, wherein said outer side consists of at least one layer of a non-tear material, characterized in that the inner side consists of an elastic, self-supporting, repetitive geometrical structure, in that the structure is covered on the top (i.e., the outer side) by a layer of non-tear material and is open in the bottom, said structure forming a continuous system of air chambers which are closed from one another by walls.

The invention is described in more detail hereinafter with reference to the accompanying drawings wherein like reference numerals denote like elements in the description.

The present invention relates to protective clothing or lining for protection against the effects of impacts, blows, gunshots or the like, comprising an inner side facing the person wearing it and an outer side facing away from the object, wherein the outer side consists of at least one layer of a non-tear material while the inner side consists of an elastic, self-supporting, repetitive geometrical structure. The structure is covered on the top by the layer of non-tear material and is open at the bottom, the structure forming a continuous system of air chambers which are closed from one another by walls The above, and other objects, features and advantages of the present invention will become apparent from the following description read in conduction with the accompanying drawings, in which like reference numerals designate the same elements.

BRIEF DESCRIPTION OF THE DRAWINGS

FIG. 1 is a fragmentary top view of an inner side of protective clothing or lining with a geometric structure according to one aspect of the present invention FIG. 2 is a fragmentary section view through the protective clothing according to one aspect of the present invention.

DETAILED DESCRIPTION OF THE PREFERRED EMBODIMENTS

Reference will now be made in detail to several embodiments of the invention that are illustrated in the accompanying drawings. Wherever possible, same or similar reference numerals are used in the drawings and the description to refer to the same or like parts or steps. the drawings are in simplified form and are not to precise scale. For purposes of convenience and clarity only, directional terms, such as top, bottom, up, down, over, above, and below may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

According to a preferred embodiment of the invention the inner side geometric structure is mesh, diamond or honeycomb shaped. As an alternative, the geometric structure can be comprised of round or bent shapes. The ratio between the height of an air chamber and its maximum diameter should range between 5:1 and 1:3. The air chambers should have a height of between 3 to 8 mm, and the maximum diameter of an air chamber is not to exceed 16 mm.

Preferably the outer side and the inner side are comprised of synthetic material that can be bonded or glued together. The geometric structure forming the inner side is produced in a continuous injection molding process or by punching, swedging or similar processes.

The outer side can have one or several layers of waterproof or impact damping material.

Preferably at least the inner side is comprised of thermoplastic elastomer or a synthetic mixture containing elastomer.

According to one variation of the invention the air chambers can have different structures.

In one embodiment, as clothing, the inner side of the protective clothing preferably is covered with a non-tear, smooth foil or similar material, whereby the foil only is intermittently fixed and air circulation is not significantly affected. In this case the protective clothing can be a cape or a poncho.

In another embodiment, as a protective lining, the lining is arranged on the bottom side of a helmet, on the inside of a bulletproof vest or other protective clothing.

The protective clothing or lining can be compressed by pushing it together and its structure automatically expands again.

Referring now to FIG. 1, showing a honeycomb structure comprised of walls 1 that enclose hollow spaces and thus form air chambers 2. FIG. 2 shows that the air chambers 2 are open in the bottom and thus form the inner side of the protective clothing or lining. The outer side consists of a non-tear foil 3 (sections in FIG. 1 shown without honeycomb structure). since at least the inner side is comprised of elastic, self-supporting material such as polyurethane, the protective clothing or lining has several advantages. The elasticity of the material used as such is energy absorbing.

The structure comprised of small, repetitive air chambers open to one side increases this effect even when the protective clothing or lining is not completely smooth. Since, however, it often is not possible that clothing or parts of a lining are smooth, the protective clothing or lining, as shown in this embodiment, has a smooth, non-tear synthetic foil 4 on its inner side. However, it does not close the air chambers 2 but rather is only intermittently glued or bonded with the structure in some points 5 so that air can escape when a blow or impact hits, which relates directly to an important goal of the present invention.

In FIG. 1 parts of the honeycomb structure are shown without this inner foil 4. Because the air chambers are open, the protective clothing or lining can be well compressed when packaging. When compressed its elasticity allows it to store energy that supports the unfolding of the protective clothing or lining—whether rolled up or folded—because it tends to unfold automatically.

In the claims, means- or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Having described at least one of the preferred embodiments of the present invention with reference to the accompanying drawings, it is to be understood that the invention is not limited to those precise embodiments, and that various changes, modifications, and adaptations may be effected therein by one skilled in the art without departing from the scope or spirit of the invention as defined in the appended claims.

The invention claimed is:

1. A protective device, comprising:

a protective construction having a first inner side portion and an opposing second outer side portion;

said first inner side portion having a first and second side, said first side facing proximate a surface to be protected;

said first inner side portion being at least a substantially elastic, self-supporting, and repetitive geometrical structure forming a plurality of honeycomb air chambers closed from one another by respective pluralities of side walls and open at opposing ends along respective first and second sides of said first inner side portion;

said first inner side portion of substantially elastic honeycomb air chambers comprising at least one of a thermosynthetic elastomer and a synthetic material mixture containing an elastomer;

said opposing second outer side portion further comprising:

non-tear waterproof material on an inner portion of said second outer side portion and continuously closing open ends of said first inner side portion along said second side;

an elastomeric layer continuously joined to said non-tear material;

each of said open ends of said first inner side portion along said first side proximate said surface to be protected remaining open and whereby said protective construction enables an elastic absorption of kinetic energy applied against said outer side and a protection of said surface to be protected.

2. A protective article, comprising:

a structure having an inner side member facing an object to be protected; and an outer side member of a non-tear waterproof material facing away from said object, said inner side member being a substantially elastic self supporting, repetitive geometrical honeycomb member forming a plurality of air chambers closed from one another by side walls and open at opposing top and bottom ends, bottom ends of said air chambers being open to enable air to outflow said air chambers responsive to an energy impact against said outer side; and tops of said air chambers being sealed by bonding with said outer side member, and thereby absorbing said energy for protecting the object from an effect of said energy;

a ratio of a height of each said air chamber to a chamber maximum diameter ranges between 5:1 and 1:3; and said air chambers have a height of between of 3 to 8 mm, and a maximum diameter of each said air chamber does not exceed 16 mm.

3. A protective article in accordance with claim 2, wherein: the geometrical member is a mesh shape.

4. A protective article in accordance with claim 2, wherein: the geometrical member is a round shape.

5. A protective article in accordance with claim 2, wherein: said inner side member and said outer side member comprised of a synthetic material that can be bonded or glued together.

6. A protective article in accordance with claim 2, wherein: the bottom face of said inner side member is adjacent a non-tear, smooth synthetic foil; and said non-tear, smooth synthetic foil being bonded to intermittent portions of said edges of said bottom end, whereby air circulation is not diminished.

7. A protective article in accordance with claim 2, wherein said article comprises at least a cape or a poncho.

8. A protective article in accordance with claim 2, wherein said article includes actuation urging means for inherently unfolding itself from one of a folded and a compressed state thereof and said actuation urging means for inherently unfolding includes said substantially elastic nature of said geometric honeycomb members.

9. A protective article having a protective construction, comprising:

at least an inside layer proximate an object requiring protection, and an outer side layer positioned distal said object;

said outer side layer including means for resisting damage under energetic impact from an external source and being waterproof;

said inside layer including means for absorbing and distributing kinetic energy transferred from said outer side layer; and said means for absorbing and distributing kinetic energy including a plurality of elastomeric partially bounded honeycomb air chambers and means for enabling a release of said air from a side of said partially bounded chambers opposite said outer side layer upon said energetic impact, wherein said means for enabling a release includes leaving an open end to said honeycomb air chambers on one side, thereby absorbing portions of said kinetic energy.

10. A protective article, comprising:

a structure having an inner side member facing an object to be protected;

an outer side member of a waterproof non-tear foil material facing away from said object, said inner side member being an elastomeric self-supporting, repetitive geometrical member forming a plurality of honeycomb air chambers closed from one another by side walls;

tops of said air chambers being sealed by said waterproof non-tear foil material;

bottoms of said air chambers being open to enable air to outflow said air chambers responsive to an energy impact against said outer side and thereby absorbing said energy for protecting the object from an effect of said energy and a layer of foil on an inner surface of said inner side member facing said object to be protected and intermittently fixed to said inner side member opposite said outer side member enabling an uninterrupted air outflow from respective said plurality of air chambers.

* * * * *